United States Patent [19]

Frantl et al.

[11] Patent Number: 4,836,967

[45] Date of Patent: Jun. 6, 1989

[54] PROCESS FOR PRODUCING A JOINT FOR A FRAMED STRUCTURE

[75] Inventors: Erich Frantl; Peter Hofstätter, both of Vienna, Austria

[73] Assignee: Drpl.-Ing. Manfred Beer, Modling, Austria

[21] Appl. No.: 2,902

[22] Filed: Jan. 13, 1987

[30] Foreign Application Priority Data

Jan. 14, 1986 [AT] Austria ..... 69/86

[51] Int. Cl.[4] ..... B28B 1/10; B29C 43/00; B32B 31/06

[52] U.S. Cl. ..... 264/69; 269/112; 269/128; 269/261; 269/262

[58] Field of Search ..... 264/261, 262, 333, 263, 264/69, 128, 112

[56] References Cited

U.S. PATENT DOCUMENTS

| | | | |
|---|---|---|---|
| 639,948 | 12/1899 | Sundh | 403/245 X |
| 2,313,110 | 3/1943 | Wertz | 264/128 X |
| 2,774,108 | 12/1956 | Wyllie | 264/128 X |
| 3,608,010 | 9/1971 | Stayner | 264/128 X |
| 3,608,029 | 9/1971 | Hough | 264/128 X |
| 4,011,020 | 3/1977 | Frantl et al. | 403/267 X |

FOREIGN PATENT DOCUMENTS

| | | | |
|---|---|---|---|
| 2211180 | 3/1974 | Fed. Rep. of Germany . | |
| 201844 | 11/1984 | Japan | 264/128 |
| 255891 | 2/1949 | Switzerland . | |
| 303302 | 7/1971 | U.S.S.R. | 264/128 |
| 947331 | 7/1982 | U.S.S.R. . | |
| 1496797 | 1/1978 | United Kingdom . | |

*Primary Examiner*—Jan H. Silbaugh
*Assistant Examiner*—Karen D. Kutach
*Attorney, Agent, or Firm*—Beveridge, DeGrandi & Weilacher

[57] ABSTRACT

A process for forming a joint for connecting a plurality of bars in a metal casing includes the steps of pouring a granulated solid into the metal casing and prestressing the solid by driving in a mandrel through the filling aperture of the casing. Thereafter, an unsinkable or a low-shrinkage hardening fluid is injected into the metal casing and permitted to harden.

10 Claims, 2 Drawing Sheets

Fig.1
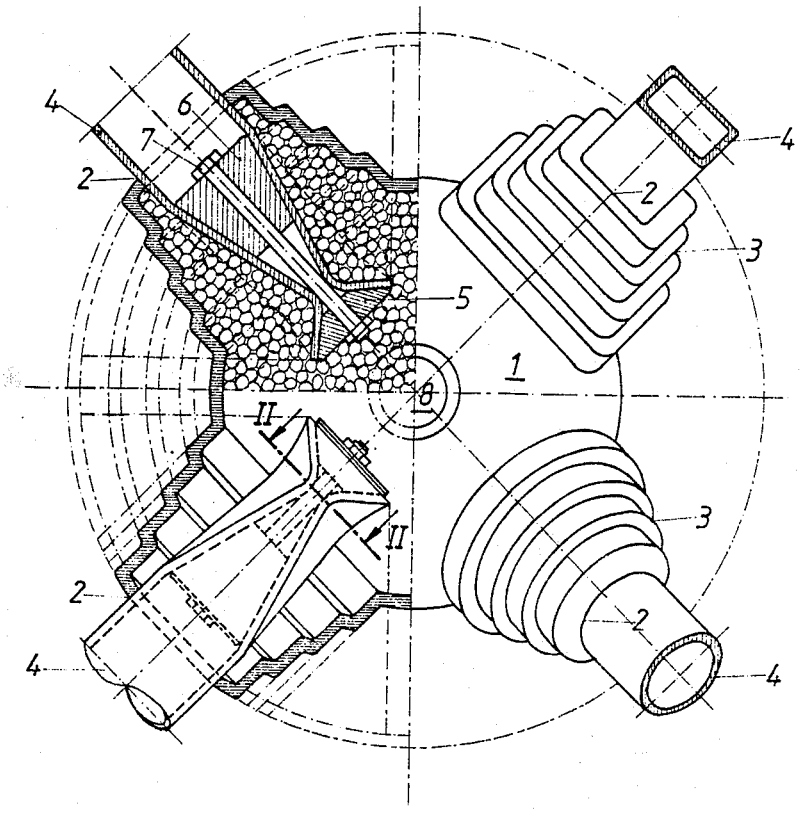
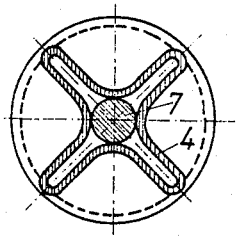
Fig.2
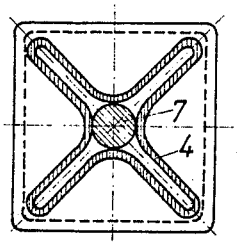
Fig.3
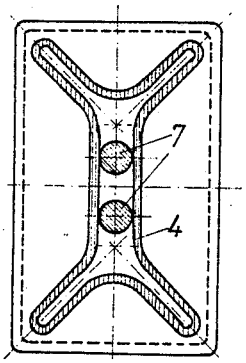
Fig.4

PROCESS FOR PRODUCING A JOINT FOR A FRAMED STRUCTURE

BACKGROUND OF THE INVENTION

The invention relates to a process for producing a joint for framed structures with more than two bars connected in a metal casing, provided with apertures through which the bars are inserted and wherein they terminate in a positive-connection-forming, e.g. a reshaped or necked-down, end portion, which joint is filled with a hardening grout.

Joint connections for framed structures having more than two bars connected in one joint are known wherein the bars are inserted through apertures in a metal casing terminate in a positive-connection-forming, e.g. reshaped or necked-down, end portion. The metal casing is filled with a hardening grout.

In joint connections known from the prior art, the grout is composed of cement-bonded concrete mortar, mortar or plastics, for which either thermoplastics or thermosetting plastics are used. Cement-bonded concrete mortar hardens too slowly, and the plastics that are considered to have the disadvantages of being relatively costly and having a low temperature stability. Moreover, to impart adequate strength to the joints, it is necessary to fill the metal casing completely, and it is difficult to accomplish filling without voids or air pockets.

Various processes are known for producing joints of the type described above.

In the joint as taught by British Pat. No. 1,496,797, a cement mortar of sand and cement, or a mixture of a hardenable plastic with sand, is injected as the hardening grout.

When producing the joint as presented by West German Laid-open Application No. 2,211,180, the bars are inserted into the metal casing, whereupon the remaining space in the metal casing is filled with a grout. Special-purpose concrete plastics, multicomponent bonding agents and the like are mentioned as grouts.

In the joint connection as exemplified in Russian Pat. No. 947,331, the hardening compound is introduced without pressure into the hollow space of the metal casing. Also, there is no showing in Russian Pat. No. 947,331 that a granulated solid was introduced beforehand into the metal casing and, if necessary, compacted or prestressed. Rather, Russian Pat. No. 947,331 takes a different approach by proposing an expanding plastic compound for filling the metal casing.

SUMMARY OF THE INVENTION

The major object of the invention is to provide a process with which a joint for framed structures, more particularly of steel constructions, can be made with little expenditure of material and can be implemented rapidly, effectively, and with simple means.

This object is achieved by pouring into the metal casing, firstly, a compression-resistant granulated solid having a grain size between 5 and 100 millimeters, prestressing the granulated solid and, finally, injecting a shrinkproof hardening fluid, e.g., a shrinkproof and rapidly hardening cement-based grouting mortar or a low-shrinkage hardening thermoplastic or thermosetting plastic into the casing. By prestressing the granulated solid, a very stable joint is obtained according to the process of the invention. The granulated solid permits faster hardening of the fluid and helps prevent the formation of voids in the metal casing. In the assembled state prior to injection of the fluid into the metal casing, a positive connection is established between the end portions of the bars by the granulated material alone, to thereby facilitate assembly. After injection and hardening of the fluid inside the metal casing, the fluid transmits part of the forces occurring therein and reduces the surface pressure between the grains of the granulated material.

Compression-resistant and temperature-resistant materials, e.g., glass or metal balls, stones, granulated slag, come into consideration as the granulated solid, whereby a substantially spherical form and a substantially uniform grain size are also of advantage.

As part of the invention, compacting the poured granulated solid by vibration has proven valuable.

When carrying out the process of the invention, it is advantageous to pour into the metal casing a granulated solid with an essentially uniform grain size, which size is preferably chosen to increase with the size of the metal casing and ranges from 5 to 100 mm, preferably from 10 to 50 mm. This results in a compact filling, free of voids in the metal casing.

In a joint with a filling aperture located on the top side of the metal casing and closable with a mandrel, it is possible, as part of the invention, to proceed in such a way that the granulated solid poured into the metal casing, and if necessary compacted, is prestressed before injecting the hardening fluid by driving a mandrel through a filling aperture provided in the metal casing. The mandrel is preferably tapered at its front end. In this way, the mandrel serves, on the one hand, to seal the metal casing after the granulated solid has been poured in and, on the other, to prestress the same. The mandrel can also have an aperture through which the fluid can be injected in a later step. As part of the invention, the mandrel is preferably driven in by screwing.

BRIEF DESCRIPTION OF THE DRAWINGS

The invention will be explained in greater detail with reference to the drawings in which like parts bear like reference numerals. In the drawings:

FIG. 1 is an elevated front view in partial cross-section along the axis of one of the bars in the joint according to the present invention;

FIGS. 2 through 4 are cross-sectional views taken along line II—II of FIG. 1 of various embodiments of the joint of the present invention.

DETAILED DESCRIPTION OF THE PREFERRED EMBODIMENTS

Figure 5:
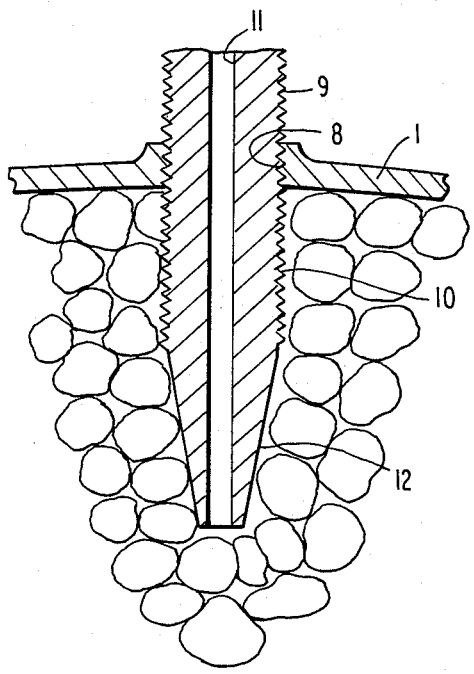
FIG. 5 is a cross-sectional view generally showing a mandrel suitable for extending into a fillin aperture of the metal casing to prestress the granulated solid therein and seal the casing.

A joint according to a preferred embodiment of the present invention is comprised of a metal casing having a convex central portion substantially in the form of a flattened sphere. Protruding stellatedly from the central portion projections 3 taper in stepwise fashion from apertures 2 in the metal casing.

In the right portion of FIG. 1 (not shown in cross section) is indicated an aperture 2 receiving a bar 4 in the form of a tube with a square cross section and another aperture 2 receiving a bar 4 in the form of a tube with a circular cross section. One advantage of the joint embodying the invention is that the bars 4 are not required to have the same cross section. For example, diagonal members can be made thinner than chord members.

In the left half of FIG. 1 are shown, connected by the joint, two bars, the axes of which lie in the plane of the drawing. Poured material in the metal casing 1 also is shown in the upper part of the left half of FIG. 1. This material is not shown in the lower part of the left half of FIG. 1 and the end portion of the bar is not shown in cross section.

It is apparent that the bars 4 terminate in the metal casing with a positive-connection-forming, necked-down end portion. It can be seen from the cross-sectional views of the necked-down end portions of bars 4 in FIGS. 2 to 4 that the neck is formed by folding the tube wall without thinning or altering its cross-sectional area.

In each necked-down end portion of bars 4, two inserted members 5 and 6 are mounted in opposing sections of the neck and oriented therein with their tapering portions facing in opposition. The neck is adapted to the shape of the inserted members 5, 6. By means of a tensioning member 7 in the form of a high-strength bolt or a plurality of such bolts (FIG. 4) located in the tube axis, the two inserted members 5, 6 are urged together longitudinally within the end portion of each the bar 4 such that the members 5, 6 come into flatwise abutting engagement with the inside walls of the tubes in opposite sections of the neck.

A filling aperture 8 is provided in the top side of the metal casing 1.

The filler material for the metal casing 1 is comprised of a compression-resistant granulated solid and a hardening fluid, which completely fills up the voids between the grains of the granulated material. Advantageously, the granulated solid is a grain-like material chosen in the range from 5 to 100 mm, preferably from 10 to 50 mm, with a grain size that, together with the fluid, ensures a homogeneous filling of the metal casing.

With reference to FIG. 5 filling aperture 8 provided in the top side of the metal casing 1 is several times larger than the grain size of the granulated solid. It can be closed with a tapered mandrel 9, generally shown in the drawing, which extends into the metal casing 1. The mandrel can be provided, for example, with an external thread 10 for engagement with a corresponding internal thread of the filling aperture 8. The mandrel 9 is shown as having an aperture 11 through which the hardening fluid can be injected.

According to the invention, the joint is produced as follows:

First, the compression-resistant granulated solid is poured into the metal casing 1, into which the end portions of the bars 4 are inserted. This granulated solid is then compacted by placing a vibrator against the metal casing 1, whereupon the mandrel 9 with its tapered end 12 extending into the metal casing 1 is screwed into the filling aperture 8 so that the granulated solid is prestressed. Finally, the shrinkproof or low-shrinkage hardening fluid is poured into the metal casing 1 through a small opening in the mandrel. At the highest point of the metal casing 1, a venting and filling-check bore (not shown in the drawing) is provided.

We claim:

1. A process for forming a joint for connecting at least three members of a frame structure in a metal casing having a filling aperture and openings therein receiving positive-connection-forming end portions of the members, the process comprising the steps of:

introducing a compression-resistant granular solid material having a grain size from 5 millimeters to 100 millimeters into the metal casing;

providing a mandrel;

driving the mandrel into the casing, through the filling aperture, to apply pressure to the material and thereby prestess the material within the casing; and injecting a shrinkproof hardening fluid into the casing.

2. The process as claimed in claim 1, further comprising the step of vibrating the casing to compact the granular solid material before prestressing the material.

3. The process as claimed in claim 1, wherein the mandrel is screwed into the metal casing.

4. The process as claimed in claim 1, wherein the hardening fluid is injected into the metal casing through an aperture provided in the mandrel.

5. The process as claimed in claim 1, wherein the positive-connection-end portions of the members are necked-down.

6. The process as claimed in claim 1, wherein the hardening fluid is a cement-based grouting mortar.

7. The process as claimed in claim 1, wherein the hardening fluid is a low-shrinkage, hardening thermoplastic.

8. The process as claimed in claim 1, wherein the hardening fluid is a thermosetting plastic.

9. The process as claimed in claim 1, wherein the granular solid material has a substantially uniform grain size, the grain size being increased corresponding to increased size of the metal casing.

10. The process as claimed in claim 9, wherein the grain size of the granular solid material is from 10 to 50 millimeters.

* * * * *